United States Patent [19]

Pederson, Jr. et al.

[11] Patent Number: 4,611,092

[45] Date of Patent: Sep. 9, 1986

[54] SURFACE MOUNT PACKAGE FOR TOROIDS

[75] Inventors: William K. Pederson, Jr.; John J. Tils, both of Cornelius, Oreg.

[73] Assignee: Tektronix, Inc., Beaverton, Oreg.

[21] Appl. No.: 703,774

[22] Filed: Feb. 21, 1985

[51] Int. Cl.[4] ..... H01F 15/10

[52] U.S. Cl. ..... 174/52 PE; 336/96

[58] Field of Search ..... 174/52 PE; 338/275, 338/276; 361/325, 310; 339/218 C, 221 M, 276 C; 336/96, 229, 192

[56] References Cited

U.S. PATENT DOCUMENTS

| | | | |
|---|---|---|---|
| 2,392,311 | 1/1946 | Christopher | 174/52 PE X |
| 2,899,631 | 8/1959 | Cushman | 336/192 X |
| 3,443,257 | 5/1969 | Mollman | 336/192 X |
| 3,684,993 | 8/1972 | Hazen, III et al. | 336/192 X |

*Primary Examiner*—Arthur T. Grimley
*Assistant Examiner*—D. A. Tone
*Attorney, Agent, or Firm*—Francis I. Gray

[57] ABSTRACT

A surface mount package for toroids or the like inductive elements has the element sandwiched between two non-conductive plates. Spring clips hold the sandwich together, and the element leads are connected to the clips. The assembly is potted, leaving only one end of the clips exposed for surface mounting on a circuit board.

4 Claims, 3 Drawing Figures

SURFACE MOUNT PACKAGE FOR TOROIDS

BACKGROUND OF THE INVENTION

1. Field of the Invention

The present invention relates to methods for mounting inductive components on a circuit board, and more particularly to a surface mount package for transformers, toroids, inductors and the like which facilitate automated fabrication of such circuit board.

2. Description of the Prior Art

Surface mounting of components on a circuit board is replacing lead mounting through circuit board holes with subsequent wave soldering or the like. For surface mounting, conductive pads on a circuit board are coated with a solder paste, components with corresponding conductive pads are placed on the circuit board, and the components are soldered to the circuit board using reflow solder techniques. This process is highly automated by use of a "pick and place" automated machine which picks the necessary components from an appropriate reel of such components and places the component in the appropriate position on the circuit board, all under microprocessor control.

For resistors, capacitors and integrated circuit chips the surface mounting technique is very efficient. However, toroids and the like inductive elements still require leads and hand-mounting on the circuit boards.

As shown in FIG. 1 this prior method requires that a toroid 10, or the like, be secured to a circuit board 12 by a rubber rattail 14 passing through holes 16 in the board, and/or by its leads 18 passing through holes 20 in the board and soldered thereto. The toroid may be either mounted flat, as shown, or on its edge. This results in a time consuming and expensive step in completing a circuit board, as well as reducing the quality of the finished product. Therefore, a surface mount package for such inductive components is desired.

SUMMARY OF THE INVENTION

Accordingly, the present invention provides a surface mount package for toroids and the like inductive elements. The inductive element is sandwiched between two non-conductive plates, the plates being joined by spring clips to which the inductive element leads are connected. The assembly is then potted, leaving only one end of the clips exposed to form the conductive pads for mounting on a circuit board.

The objects, advantages and novel features of the present invention will be apparent from the following detailed description when read in conjunction with the appended claims and attached drawing.

DESCRIPTION OF THE PREFERRED EMBODIMENT

Figure 1:
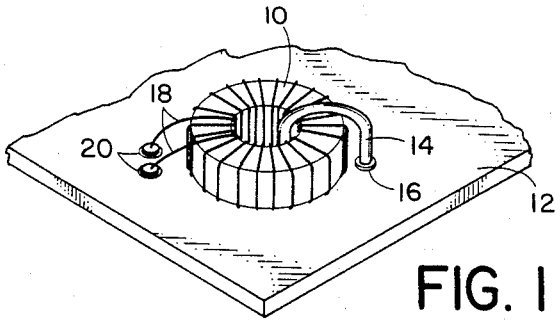
FIG. 1 (PRIOR ART)
FIG. 1 is a perspective view of an inductive element mounted on a circuit board according to the prior art.
Figure 2:
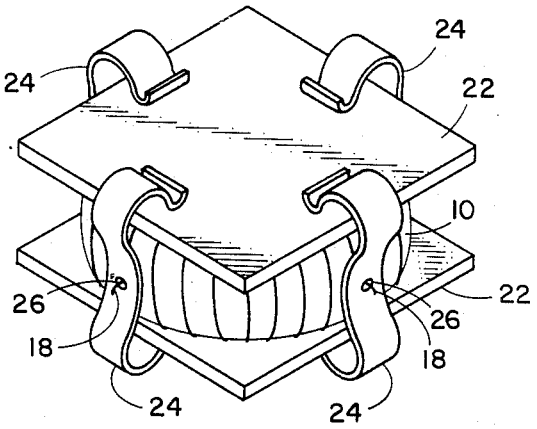
FIG. 2 is a perspective view of an inductive element sandwich according to the present invention.
Figure 3:
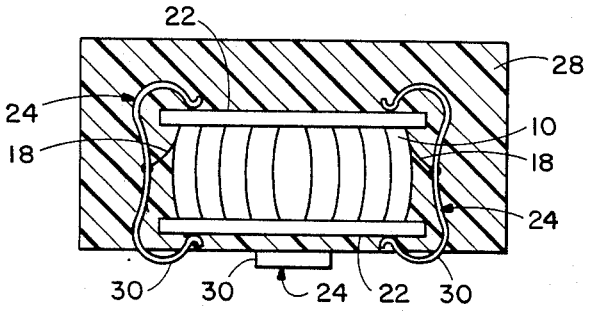
FIG. 3 is a partial cross-sectional view of the inductive element surface mount package according to the present invention.

Referring now to FIGS. 2 and 3 a surface mount package for a toroid or the like inductive element is shown. The toroid 10 is sandwiched between a pair of non-conductive plates 22. The resulting sandwich is held together by a plurality of spring clips 24. The toroid leads 18 are led out to openings 26 in the clips 24 where they are attached by conventional means, such as soldering. The resulting sandwich assembly is then embedded in a potting material 28, leaving only one end 30 exposed to form the conductive pads for connection to a circuit board.

The non-conductive plates 22 are made from a lightweight, rigid, plastic or glass epoxy. The clips are made of a conductive, springy material, such as a plated beryllium/copper alloy which can be readily chemically milled or die punched. The potting compound 28 is a non-conductive material such as RTV, a silicone rubber conformal coating, which is able to withstand the temperatures required by the surface mounting techniques. The potting compound 28 is applied either by vacuum forming, dipping, or the like, to prevent crushing of the toroid 10, and provides a moisture resistant environment. The top of the finished package is flat and smooth so it can be reeled for use by an automated "pick and place" machine.

Thus, the present invention provides a surface mount package for toroids, transformers, inductors and the like which allows automated mounting of such components on a circuit board.

What is claimed is:

1. A surface mount package for an electrical element having conductive leads comprising:

a pair of non-conductive plates, said electrical element being placed between said plates to form a sandwich;

means for holding said sandwich together to form a sandwich assembly, the leads of said electrical element being connected to said holding means and a portion of said holding means forming an electrical contact pad for surface mounting of said package on a circuit board; and a housing having a flat top and a bottom, said housing enclosing said sandwich assembly except for said electrical contact pad which is exposed at said bottom.

2. A surface mount package as recited in claim 1 wherein said housing comprises a potting compound material in which said sandwich assembly is embedded.

3. A surface mount package as recited in claim 2 wherein said holding means comprises a plurality of spring clips, one end of said spring clips forming said electrical contact pad.

4. A surface mount package as recited in claim 3 wherein said spring clips comprise a beryllium/copper alloy material plated with a conductive material.

* * * * *